US007172543B2

(12) United States Patent
Uesaka et al.

(10) Patent No.: US 7,172,543 B2
(45) Date of Patent: Feb. 6, 2007

(54) CONDUCTIVE ROLLER

(75) Inventors: Kenichi Uesaka, Hyogo (JP); Takayuki Hattori, Hyogo (JP); Jun Ochi, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 511 days.

(21) Appl. No.: 10/705,941

(22) Filed: Nov. 13, 2003

(65) Prior Publication Data

US 2004/0147383 A1 Jul. 29, 2004

(30) Foreign Application Priority Data

Nov. 15, 2002 (JP) ..... 2002-332345

(51) Int. Cl.
*B25F 5/02* (2006.01)

(52) U.S. Cl. ..... 492/56; 492/53

(58) Field of Classification Search ..... 492/59, 492/56, 53

See application file for complete search history.

(56) References Cited

U.S. PATENT DOCUMENTS 5,241,357 A * 8/1993 Iwata ..... 399/231
5,390,012 A * 2/1995 Miyashiro et al. ..... 399/303
5,602,712 A * 2/1997 Daifuku et al. ..... 361/225
5,786,091 A * 7/1998 Kurokawa et al. ..... 428/421
5,978,639 A * 11/1999 Masuda et al. ..... 399/302
6,360,069 B1 * 3/2002 Mimura et al. ..... 399/286
6,625,412 B2 * 9/2003 Takami et al. ..... 399/176
2002/0086781 A1 * 7/2002 Okuda et al. ..... 492/56
2002/0197081 A1 * 12/2002 Takami et al. ..... 399/176

FOREIGN PATENT DOCUMENTS

JP 11-249386 A 9/1999

* cited by examiner

*Primary Examiner*—Marc Jimenez
(74) *Attorney, Agent, or Firm*—Birch, Stewart, Kolasch and Birch, LLP

(57) ABSTRACT

A conductive roller including a core metal and a conductive elastic layer disposed on a peripheral surface of the core metal. The conductive roller has an electrostatic capacity not more than 50 pF at 100 Hz and an electric resistance not less than $10^5\Omega$ nor more than $10^9\Omega$ at an applied voltage 1000V. An electrostatic capacity C (L) at an alternating low frequency (L) and an electrostatic capacity C (H) at an alternating high frequency (H) satisfy the following relationship:

$$0<(C(L)-C(H))/(\log_{10} \mathrm{Hz}(H)-\log_{10} \mathrm{Hz}(L))<10.$$

19 Claims, 3 Drawing Sheets

CONDUCTIVE ROLLER

This Nonprovisional application claims priority under 35 U.S.C. § 119(a) on Patent Application No(s). 2002-332345 filed in Japan on Nov. 15, 2002, the entire contents of which are hereby incorporated by reference.

BACKGROUND OF THE INVENTION

Field of the Invention

The present invention relates to a conductive roller. More particularly, the present invention relates to a conductive roller for use in the image-forming mechanism of electrophotographic apparatuses of an office appliance such as a printer, a copying apparatus, a facsimile, and an ATM. The present invention is intended to provide the conductive roller whose electrical characteristic is improved to suppress occurrence of toner dispersion.

The following conductive rollers are used in the conductive mechanism of the electrophotographic image-forming apparatuses such as the printer, the electrophotographic copying apparatus, the facsimile, and the like: a charging roller for uniformly charging a photosensitive member, a toner supply roller for transporting toner, a development roller for attaching the toner to the photosensitive member, and a transfer roller for transferring a toner image to paper.

The conductive roller has a columnar core metal and a vulcanized rubber layer concentrically layered on the peripheral surface of the core metal. The conductive rollers are demanded to have performance of conduction such as electric resistance, not staining the photosensitive member, and a low hardness. The transfer roller transfers an electrostatic latent image formed on the photosensitive member to paper. Therefore the conduction of the transfer roller such as its electric resistance is an important parameter.

To control the electric resistance of the conductive roller, in a known method, conductive oligomer containing a polyether structure such as a polyethylene oxide or a conductive plasticizer is added to a rubber component. This method has a disadvantage of staining a photosensitive member because they are liable to bleed.

In another known method, a conduction-imparting agent such as carbon black or a metal oxide is kneaded into a rubber component and dispersed therein to thereby control the electric resistance of the conductive roller. The electric resistance value of the carbon black changes abruptly in a region owing to a slight change of an addition amount thereof to the rubber component. Thus it is difficult to control the electric resistance of the conductive roller by using the carbon black.

In another known method of solving the problem of the variation of the electric resistance, the mixture of an ionic-conductive polymer such as epichlorohydrin rubber having a low electric resistance value and an ionic-conductive polymer such as NBR having a high electric resistance value is used as the rubber component of the conductive roller. This method is capable of easily controlling the electric resistance of the conductive roller by merely changing the mixing ratio between both ionic-conductive polymers. However, the epichlorohydrin rubber contains halogen. Thus in burning the rubber layer of the conductive roller or decomposing it by heating or shearing it to recycle it, there is a fear that harmful gases such as hydrogen chloride and dioxin are generated in dependence on a treatment condition. That being the case, this method is disadvantageous in that in discarding the rubber layer, care should be taken not to pollute environment with harmful gases.

The use of the epichlorohydrin rubber causes increase in the electrostatic capacity of the conductive roller and in the degree of dependence of the electrostatic capacity on frequency. Thus to reduce the electrostatic capacity of the conductive roller, it is preferable to adjust the electric resistance thereof by using a conductive material.

Even though the conductive roller is designed to allow the electric resistance value to have a predetermined value, toner adheres to both axial ends of the photosensitive member during a developing operation. As a result, a toner disperses on paper. That is, toner to be transferred to the paper has dispersion (deviation of toner).

To prevent this problem, namely, to prevent toner from attaching to the axial ends of the photosensitive member and dispersing to paper and the like, the conductive roller is proposed as disclosed in Japanese Patent Application Laid-Open No. 11-249386. The electrostatic capacity of the conductive roller in the region spaced by 15% of the entire length of the conductive roller from both axial ends is set larger than that of the other region thereof.

However, in the conductive roller disclosed in Japanese Patent Application Laid-Open No. 11-249386, the nip at the axial ends thereof is reduced to increase the electrostatic capacity. Thereby the apparent electric resistance is increased. When the electrostatic capacity of the material itself is increased too much by varying frequencies, the toner dispersion will occur. That is, unless the entire electrostatic capacity of the conductive roller falls within a certain range, toner attaches to portions other than the axial ends of the photosensitive member and disperses to paper and the like.

SUMMARY OF THE INVENTION

The present invention has been made in view of the above-described problems. Therefore it is an object of the present invention to provide a conductive roller that allows its electric resistance to be adjusted easily, its electrostatic capacity to be small, its electric characteristic to be superior, and can be prevented from causing toner dispersion.

To achieve the object, the present invention provides a conductive roller including a core metal; and a conductive elastic layer disposed on a peripheral surface of the core metal. The conductive roller has an electrostatic capacity not more than 50 pF at the frequency of 100 Hz and an electric resistance not less than $10^5\Omega$ nor more than $10^9\Omega$ at an applied voltage 1000V.

The toner dispersion occurs owing to the difference in polarization speeds of media (conductive filler such as carbon black, conductive member, polar molecular), contained in the material of the conductive elastic layer, through which electricity flows. When the polarization speed is low, the toner dispersion is liable to occur. The present inventors have thought that the phenomenon of the toner dispersion occurs to a low extent, when the conductive roller has a small electrostatic capacity which is an index indicating the polarization speed. They have made energetic researches and found that it is possible to suppress the occurrence of the toner dispersion by reducing the electrostatic capacity to thereby reduce the degree of dependence of the electrostatic capacity on frequencies. Thus the present inventors have specified the electrostatic capacity to not more than 50 pF.

That is, the electric resistance of the conductive roller of the present invention is set to not less than $10^5\Omega$ nor more than $10^9\Omega$ at an applied voltage of 1000V, and the electrostatic capacity of the conductive roller is set to not more than 50 pF at a frequency of 100 Hz. Thereby it is possible to adjust the polarization speeds of the media to an appropriate speed and suppress the occurrence of the toner dispersion. Consequently it is possible to attach toner to a desired position reliably. Thereby it is possible to obtain a high-quality image.

If the electrostatic capacity of the conductive roller of the present invention is more than 50 pF at the frequency of 100 Hz, the polarization speed is low, which does not provide the effect of suppressing the occurrence of the toner dispersion. The electrostatic capacity may be set close to zero. It is favorable to set the electrostatic capacity to not less than 10 pF nor more than 30 pF.

The frequency characteristic of the electrostatic capacity of the material appears easily at the frequency of 100 Hz. The increase degree of the electrostatic capacity at the frequency of 100 Hz is higher than the increase degree thereof at high frequencies. The electrostatic capacity of a material which depends much on the frequency becomes sufficiently large at the frequency of 100 Hz. Therefore the correlation between the frequency and the toner dispersion can be understood well by specifying the electrostatic capacity at the frequency of 100 Hz. The electrostatic capacity means the electrostatic capacity of the entire conductive roller including its core metal.

The electric resistance value of the conductive roller of the present invention is set to not less than $10^5\Omega$ nor more than $10^9\Omega$. This is because the electric resistance value in this range is suitable as the electric resistance value of a development roller, a charging roller, a transfer roller, and a toner supply roller for use in a color copying apparatus and a color printer. If the electric resistance value of the conductive roller is less than $10^5\Omega$, high electric current flows. Consequently a defective image is liable to be formed. On the other hand, if the electric resistance value of the conductive roller is more than $10^9\Omega$, a transfer operation, a charging operation, and a toner supply operation are performed at a low efficiency. Thus the conductive roller is unsuitable for putting it into practical use. It is more favorable to set the electric resistance value of the conductive roller to not less than $10^6\Omega$ nor more than $10^9\Omega$.

In the conductive roller of the present invention, an electrostatic capacity C(L) at an alternating low frequency of $10^2$ Hz(L) and an electrostatic capacity C(H) at an alternating high frequency of $10^5$ Hz(H) satisfy a relationship of:

$$0<(C(L)-C(H))/(\log_{10}\mathrm{Hz}(H)-\log_{10}\mathrm{Hz}(L))<10$$

That is, it is preferable that the value obtained by dividing the difference between the electrostatic capacity C(L) at the alternating low frequency of $10^2$ Hz(L) and the electrostatic capacity C(H) at the alternating high frequency of $10^5$ Hz(H) by the difference between the value of the logarithm of Hz(H) and the value of the logarithm of Hz(L) is less than 10.

If the value of the above equation is more than 10, the electrostatic capacity depends much on the frequency. Thus the toner dispersion is liable to occur.

The low frequency means the range of 100 Hz to 1000 Hz, while the high frequency means 10000 Hz to 100000 Hz. At frequencies higher than 1000 Hz, the electrostatic capacity of the conductive elastic layer made of a material which causes the toner dispersion is almost equal to the electrostatic capacity of the conductive elastic layer made of a material which does not cause the toner dispersion. On the other hand, at the low frequency of about 100 Hz, the material that causes the toner dispersion has a larger electrostatic capacity than the material which does not cause the toner dispersion. Therefore the electrostatic capacity at the alternating low frequency of $10^2$ Hz(L) and the electrostatic capacity C(H) at the alternating high frequency of $10^5$ Hz(H) are used as the values for evaluation. The material that does not cause the toner dispersion is used in the present invention to prevent the conductive roller from generating the toner dispersion.

To optimize the electrical performance of the conductive roller, the conductive elastic layer is composed of a rubber composition consisting of a rubber component and an ionic-conductive filler added to the rubber component. The ionic-conductive filler consists of a lithium salt, a potassium salt, a quaternary ammonium salt or an imidazolyl salt each having a fluoro group and a sulfonyl group capable of dissociating into anions and cations.

As described above, the conductive elastic layer contains the ionic-conductive filler consisting of the anion-containing salt having the fluoro group and the sulfonyl group as the conductive filler thereof. The electric charge of the anion-containing salt having the fluoro group and the sulfonyl group is not localized owing to a strong electron attraction effect. Thus anions are stable, and the anion-containing salt having the fluoro group and the sulfonyl group displays a high degree of dissociation and allows the conductive elastic layer to have a very high degree of ionic conductance.

It is possible to realize a low electric resistance efficiently by adding the anion-containing salt having the fluoro group and the sulfonyl group to the rubber component and uniformly dispersing it therein. Thus by appropriately adjusting the mixing rate of the rubber component, it is possible to provide the conductive elastic layer with a low electric resistance and prevent the photosensitive member from being stained without deteriorating other properties of the conductive elastic layer.

More specifically, the conductive elastic layer is composed of a rubber composition containing a rubber component consisting of at least one rubber selected from among ethylene-propylene-diene terpolymer (EPDM), acrylonitrile butadiene rubber (NBR), and butadiene rubber (BR); and not more than 20 parts by weight of an anion-containing salt having a fluoro group and a sulfonyl group added to 100 parts by weight of the rubber component as an ionic-conductive filler. If more than 20 parts by weight of the anion-containing salt having the fluoro group and the sulfonyl group is added to the rubber component, the electrostatic capacity of the conductive roller becomes large.

The anion-containing salt having the fluoro group and the sulfonyl group is added to the rubber component at favorably not less than 0.01 parts by weight nor more than 20 parts by weight and at more favorably not less than 5 parts by weight nor more than 15 parts by weight for 100 parts by weight of the rubber component.

As the anion-containing salt having the fluoro group and the sulfonyl group, a salt having bisfluoroalkylsulfonylimide ions and a salt having trisfluoroalkylsulfonylimide ions are preferable.

The main chain of the EPDM consists of saturated hydrocarbons and does not have double bonds. Therefore, even though the EPDM is exposed to a high-density ozone atmosphere or irradiated with light for a long time, the molecular main chain is hardly cut. Accordingly, it is possible to enhance weatherability and oxidation resistance. As the EPDM, it is possible to use an oil-unextended type consisting of a rubber component and an oil-extended type containing the rubber component and an extended oil. In the present invention, it is possible to use both types. From the above-described viewpoint, the EPDM can be used at not less than 20 wt % nor more than 100 wt % for the entire rubber. In the case where the EPDM is mixed with the NBR and the BR, it is preferable that the EPDM is used at not less than 20 wt % nor more than 40 wt % for the entire rubber.

The NBR is preferable because it has superior properties: It has low compression permanent set and hardness. The mixture of the EPDM and the NBR (liquid state is preferable) allows the polymer chain to be easily movable. That is, the NBR allows the rubber composition to have high processability and ion transport efficiency to be high. Thus the electric resistance of the conductive roller can be reduced. Because the acrylonitrile butadiene rubbers (NBR) containing a small amount of nitrile has a low Tg, they allow the viscoelasticity and the electric resistance value of the conductive elastic layer (rubber composition) to be less dependent on environment and allow the conductive elastic layer to display very favorable properties in the neighborhood of the room temperature. It is preferable that not less than 20 wt % nor more than 80 wt % of the NBR is contained in the entire rubber.

The butadiene rubber (BR) is preferable because it has a low Tg and is independent of environment. It is preferable that the entire rubber contains the BR at not less than 20 wt % nor more than 80 wt %.

As the rubber component of the conductive elastic layer, it is possible to use isoprene rubber (IR), natural rubber (NR), stylene-butadiene rubber (SBR), styrene rubber, butyl rubber (IIR), polyisobutylene, silicone rubber (Si), urethane rubber (U), and acrylic rubber. A softener such as oil, an age resistor, and fillers may be added to the rubber component as necessary.

The addition of a chemical foaming agent to the rubber component allows the rubber composition to be sponge-like and allows the conductive roller to have a Shore E hardness not less than 20 nor more than 40 to use the conductive roller as a member such as a transfer roller which requires a proper nip width. Thereby it is possible to increase the nip width when the conductive roller is pressed against a member for holding an electrostatic latent image.

If the Shore E hardness of the conductive roller is less than 20, the conductive roller is so soft that it has a low wear resistance. On the other hand, if the Shore E hardness is more than 40, the conductive roller is so hard that a defective image is liable to be generated when the conductive roller contacts a stiff photosensitive member. It is favorable that not less than two parts by weight nor more than 12 parts by weight of a chemical foaming agent and not more than 12 parts by weight of a foaming assistant are added to 100 parts by weight of the rubber component.

As the vulcanizing agent, powdered sulfur is preferable because it is capable of realizing a low electric resistance. It is also possible to use organic sulfur-containing compounds and peroxides. As the organic sulfur-containing compound, it is possible to use tetramethylthiuram disulfide and N,N-dithiobismorpholine. As the peroxide, it is possible to use benzoyl peroxide. In performing vulcanization and foaming, the sulfur is more favorable than the organic sulfur-containing compounds and peroxides, because the sulfur allows the vulcanization speed and the foaming speed to be favorably balanced with each other.

The vulcanizing agent is added to the rubber component at favorably not less than 0.5 parts by weight nor more than five parts by weight and at more favorably not less than one part by weight nor more than three parts by weight for 100 parts by weight of the rubber component.

The following vulcanizing accelerators may be added to the rubber component: inorganic accelerators such as slaked lime, magnesia (MgO), litharge (PbO); and organic accelerators shown below.

As the organic accelerator, it is possible to use the following substances in combination: thiazoles such as 2-melcapto•benzothiazole, dibenzothiazyl disulfide, N-cyclohexyl-2-benzothiazolesulfene; sulfinamides; thiurams such as tetramethylthiuram monosulfide, tetramethylthiuram disulfide, tetraethylthiuram disulfide, and dipentamethylenethiuram tetrasulfide; and thiourea derivatives.

The vulcanizing accelerators are added to the rubber component at favorably not less than 0.5 parts by weight nor more than five parts by weight and at more favorably not less than one part by weight nor more than four parts by weight for 100 parts by weight of the rubber component.

The conductive roller of the present invention can be produced by conventional methods. For example, the rubber composition (mixture) whose components have been mixed with one another in a predetermined ratio is supplied to a rubber-kneading apparatus such as an open roll, a Banbury mixer or the like. After the rubber composition is kneaded at 100° C. for one to 20 minutes, it is tubularly preformed by a single-axis extruder. After the preform is vulcanized at 160° C. for 10 to 60 minutes, a core metal is inserted into a hollow portion of the tube. After the surface of the tube is polished, the tube is cut to a predetermined size to obtain a rubber roller. The kneaded rubber composition is vulcanized by an electric press machine, a vulcanizing can, electron beams, and the like. The vulcanizing time period should be set by using a vulcanization testing rheometer (for example, Curelastometer), although it varies according to the kind of the rubber component, the vulcanizing agent and the like, the mixing ratio among the components, the kind and amount of the foaming agent and the foaming assistant. The vulcanization temperature may be set around 160° C. in dependence on necessity. To suppress the stain of the photosensitive member, it is preferable to set the vulcanization temperature and the vulcanization time period so that sufficient vulcanization can be accomplished.

The kneaded rubber composition can be molded before or while it is being vulcanized. For example, after the kneaded rubber composition is molded compressively in a roller-shaped die, the die is heated to vulcanize it. Alternatively, the rubber composition may be vulcanized while it is being molded into a desired configuration such as a tubular configuration (roller configuration), a sheet configuration, a belt configuration by injection molding, transfer molding or extrusion.

The cylindrical conductive elastic layer has a thickness of favorably 3 mm to 9 mm and more favorably 4 mm to 6 mm. If the conductive elastic layer has a thickness less than 3 mm, it is difficult to obtain a nip having a proper dimension. On the other hand, if the conductive elastic layer has a thickness more than 9 mm, it is difficult to make the conductive roller compact.

To improve the mechanical strength of the conductive roller, fillers may be added to the rubber component as necessary so long as they do not affect the electric resistance of the conductive roller adversely. As the fillers, it is possible to use powdered substances such as silica, carbon black, clay, talc, calcium carbonate, dibasic lead phosphite (DLP), basic magnesium carbonate, and alumina. It is favorable to add not more than 30 wt % of the filler for the entire conductive roller. This is because although the addition of the filler to the rubber component is effective for improving the tensile strength and tear strength of the rubber composition, the addition of too much amount of the filler deteriorates the flexibility of the rubber composition.

The conductive roller of the present invention may have one conductive elastic layer or two or three rubber layers in addition to the conductive elastic layer to adjust the electric resistance of the conductive roller and protect the surface thereof. In this case, it is possible to appropriately adjust the mixing ratio of the components of each layer, the layering order, and the thickness of each layer. It is preferable that neither the rubber component nor other parts of the conductive roller contain halogen. The core metal may be made of metal such as aluminum, aluminum alloy, SUS, iron or of ceramics.

As apparent from the foregoing description, according to the present invention, since the electric resistance of the conductive roller is set low and its electrostatic capacity at the frequency of 100 Hz is specified in the above-described range, the conductive roller can be reliably prevented from causing the toner dispersion. Thus it is possible to improve the electrical characteristics of the conductive roller and obtain a high-quality image.

Since the conductive elastic layer of the conductive roller of the present invention contains the rubber component selected from among the EPDM, the NBR, and the BR, the conductive elastic layer is resistant to ozone. Since the conductive elastic layer does not contain the halogen component, the halogen component does not make a secondary reaction. Further it is possible to realize reduction of the compression permanent set and the electric resistance value of the conductive roller. Thus in burning the conductive roller to discard it, there is no fear that harmful gases such as hydrogen chloride are generated. Therefore the conductive roller of the present invention does not pollute environment.

Further it is possible to provide the conductive elastic with a low electric resistance efficiently by adding a small amount of the anion-containing salt having the fluoro group and the sulfonyl group capable of dissociating into anions and cations to the rubber component without deteriorating other properties of the conductive elastic layer.

Therefore the conductive roller of the present invention can be used suitably for the image-forming mechanism of electrophotographic apparatuses of an office appliance such as a laser beam printer, an inject printer, a copying apparatus, a facsimile, an ATM, and the like. More specifically, the conductive roller can used very usefully as a development roller for attaching toner to a photosensitive member, a charging roller for uniformly charging the photosensitive drum, a transfer roller for transferring a toner image from the photosensitive member to paper, a toner supply roller for transporting the toner, and a driving roller for driving a transfer belt from the inner side thereof. The conductive roller is particularly suitable as the transfer roller because it allows a nip width to be increased and occurrence of toner dispersion to be suppressed, which allows the toner image to be transferred efficiently to paper.

DETAILED DESCRIPTION OF THE PREFERRED EMBODIMENTS

The embodiments of the present invention will be described below with reference to the drawings.

Figure 1:
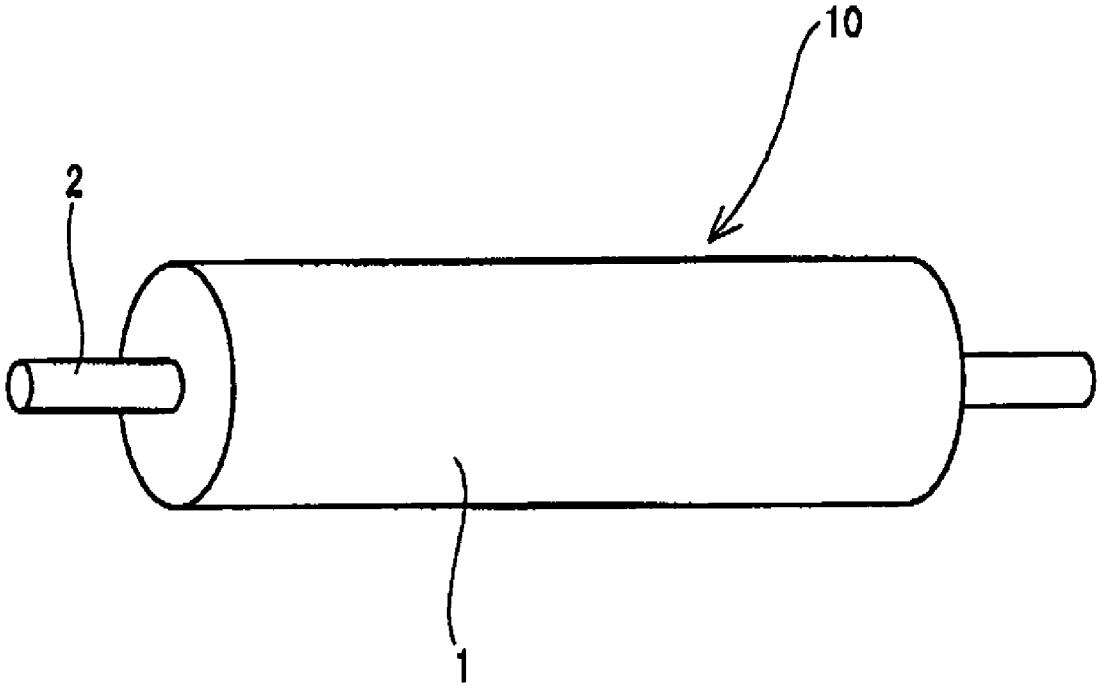
FIG. 1 is a schematic view showing a conductive roller of the present invention.

FIG. 1 shows a conductive roller 10 of the first embodiment. The conductive roller 10 has a conductive columnar core metal 2 made of SUS and a cylindrical conductive elastic layer 1 disposed on the peripheral surface of the core metal 2. The core metal 2 is mounted in a hollow portion of the conductive elastic layer 1 by press fit.

The rubber component of the conductive roller 10 consists of 30 parts by weight of EPDM not containing halogen and 70 parts by weight of NBR. The conductive elastic layer 1 of the conductive roller 10 is composed of a rubber composition containing five parts by weight of the ionic-conductive filler, namely, the anion-containing salt having the fluoro group and the sulfonyl group added to 100 parts by weight of the rubber component. The conductive elastic layer 1 composed of the rubber composition not containing halogen is foamed by using a chemical foaming agent. As the anion-containing salt having the fluoro group and the sulfonyl group, lithium-bis(trifluoromethanesulfonyl)imide is used. As the chemical foaming agent, eight parts by weight of a mixture of azodicarbonamide (ADCA) and 4,4'-oxybis(benzene sulfonyl hydrazide) (OBSH) is used for 100 parts by weight of the rubber component. As a foaming assistant, four parts by weight of urea is used for 100 parts by weight of the rubber component.

The following agents are added in a necessary amount to the rubber component: A vulcanizing agent (sulfur), a vulcanizing accelerator (dibenzothiazolyl disulfide), and an inorganic filler (calcium carbonate light). The rubber composition does not contain the halogen.

After the rubber composition is kneaded, it is extruded cylindrically by an extruder to preform it. The obtained preform is cut to a predetermined size. The preform is supplied to a vulcanizing can of a pressure/water vapor type. In the vulcanizing can, the chemical foaming agent gasifies and foams, and the rubber component is vulcanized at a rubber component-crosslinking temperature.

Vulcanizing conditions are adjusted according to the kind of the rubber component, additives such as the chemical foaming agent, and the vulcanizing agent and mixing ratios among the components. After a shaft, namely, the core metal (ϕ 6 mm) 2 is inserted into the hollow portion of the obtained cylindrical conductive elastic layer 1, the peripheral surface of the conductive elastic layer 1 is polished and cut.

The chemical foaming agent is added to the rubber component to make the rubber composition sponge-like. Thereby the Shore E hardness of the conductive roller 10 is set to 33. The conductive roller 10 has an electrostatic capacity of 33 pF at a frequency of 100 Hz and an electric resistance of $10^{7.5}\Omega$ at an applied voltage 1 kV. A value of 2.7 is obtained by dividing the difference between an electrostatic capacity C(L) at an alternating low frequency of Hz(L) and an electrostatic capacity C(H) at an alternating high frequency of Hz(H) by the difference between the value of the logarithm of Hz(H) and the value of the logarithm of Hz(L). That is, the value of an equation 1: $(C(L)-C(H))/(\log_{10} Hz(H)-\log_{10} Hz(L))$ is 2.7.

More specifically, in the first embodiment, the low frequency Hz(L) is set to $10^2$ Hz. The electrostatic capacity C(L) is set to 33 pF. The high frequency Hz(H) is set to $10^5$ Hz. The electrostatic capacity C(H) is set to 25 pF. Thus the value of the equation 1 is 2.7.

The conductive roller 10 has a low electric resistance of $10^{7.5}\Omega$ and a small electrostatic capacity of 33 pF. The value of the equation 1 is 2.7. Therefore it is possible to suppress occurrence of toner dispersion securely. The conductive roller 10 does not contain halogen such as chlorine. The electric resistance of the conductive roller 10 can be adjusted. Further the conductive roller 10 has a low compression set and hardness. Therefore the conductive roller 10 can be used suitably as a development roller, a charging roller, a transfer roller, and the like of electrophotographic apparatuses such as a copying apparatus, a facsimile, a printer, and the like. The conductive roller 10 can be used as the transfer roller most suitably.

The rubber component of the conductive elastic layer 1 may consists of only EPDM. Alternatively the rubber component may consist of NBR or BR by appropriately adjusting the amount thereof. In addition, desired amounts of conductive fillers may be added to the rubber component. The foaming agent does not necessarily have to be added to the rubber component.

Only one conductive elastic layer 1 is formed on the peripheral surface of the core metal 2. But two or more rubber layers may be formed on the peripheral surface of the core metal 2 to adjust the electric resistance of the conductive roller 10 and protect the surface thereof. In this case, it is possible to appropriately adjust the mixing ratio among the components of each layer, the layering order, and the thickness of each layer. The core metal 2 may be made of metal such as aluminum, aluminum alloy, iron or of ceramics.

Examples 1 through 16 of the conductive roller of the present invention and comparison examples 1 through 6 will be described in detail below. The conductive roller of each of the examples 1 through 16 and the comparison examples 1 through 6 was produced by conventional methods. That is, kneading, extrusion, vulcanization, and molding, and polishing are performed. Thereby the conductive roller of each of the examples and comparison examples was formed. Each conductive roller had a shaft diameter of ϕ 6 mm, a roller diameter of ϕ 15 mm, and an axial rubber length of 230 mm. That is, the thickness of the conductive elastic layer was 9 mm. More specifically, after the components shown in tables 1 and 2 supplied to a kneader were kneaded at 100° C. for one to 20 minutes, the mixture was tubularly extruded from a rubber-kneading apparatus to obtain a preform. After the preform was vulcanized at 160° C. for 30 minutes, an iron shaft (diameter: ϕ 6 mm) was inserted into the hollow portion of the tube. After the surface of the tube was polished, the tube was cut to a predetermined size to obtain the conductive roller (outer diameter: ϕ 15 mm, length: 230 mm) of each of the examples 1 through 16 and the comparison examples 1 through 6.

TABLE 1

| Components | Name | Maker | Example 1 | Example 2 | Example 3 | Example 4 |
|---|---|---|---|---|---|---|
| BR | BR11 | JSR | | | | |
| EPOM | EPT4045 | Mitsui Kagaku | 30 | 30 | 30 | 100 |
| NBR | Nippol 401LL | Zeon | 70 | 70 | 70 | |
| Epichlorohydrin rubber | Zecron 3106 | Zeon | | | | |
| EO-PO-AGE copolymer | ZSN8030 | Zeon | | | | |
| Chloroprene | NeopreneWRT | Showa Denko Du-Pont | | | | |
| Conductive addition salt 1 | Lithium-bis (trifluoromethanesulfonyl) imide | Sumitomo Three M | 0.2 | 5 | 10 | 5 |
| Conductive addition salt 2 | Lithium-trifluoromethanesulfonate | Morita Kagaku Kogyo | | | | |
| Conductive addition salt 3 | IL-A1 | Koei Kagaku Kogyo | | | | |
| Conductive addition salt 4 | EMI-TSFI | Stera Chemipha | | | | |
| Conductive addition salt 5 | Potassium-bis(trifluoromethanesulfonyl) imide | Morita Kagaku Kogyo | | | | |
| Carbon HAF | Sheast 3 | Tokai Carbon | 5 | 5 | 5 | 5 |
| Inorganic filler | Calcium carbonate light | Maruo Calcium | 20 | 20 | 20 | 20 |
| Foaming agent 1 | Neocellbon N1000SW | Eiwa Kasei | 4 | 4 | 4 | 4 |
| Foaming agent 2 | Vinyhall AC#3 | Eiwa Kasei | 4 | 4 | 4 | 4 |
| Foaming assistant | Cellpaste 101 | Eiwa Kasei | 4 | 4 | 4 | 4 |
| Vulcanizing agent | Sulfur | Tsurumi Kagaku | 1 | 1 | 1 | 1 |
| Vulcanizing accelerator | DM | Ouchi Shinko Kagaku | 1 | 1 | 1 | 1 |
| Hardness (C) | | | 35 | 33 | 31 | 37 |
| Electric resistance | | | 8.8 | 7.5 | 6.9 | 8.5 |
| Stain of photosensitive member | | | ○ | ○ | ○ | ○ |
| Electrostatic capacity (100 Hz) | | | 31 | 33 | 35 | 28 |
| Equation 1 | | | 2.0 | 2.7 | 3.3 | 1.0 |
| Toner dispersion | | | Not occurred | Not occurred | Not occurred | Not occurred |
| Determination | | | ○ | ○ | ○ | ○ |

| Components | Name | Maker | Example 5 | Example 6 | Example 7 | Example 8 |
|---|---|---|---|---|---|---|
| BR | BR11 | JSR | 70 | 30 | | |
| EPOM | EPT4045 | Mitsui Kagaku | 30 | 70 | 30 | 30 |

TABLE 1-continued

| | | | | | | |
|---|---|---|---|---|---|---|
| NBR | Nippol 401LL | Zeon | | | 70 | 70 |
| Epichlorohydrin rubber | Zecron 3106 | Zeon | | | | |
| EO-PO-AGE copolymer | ZSN8030 | Zeon | | | | |
| Chloroprene | NeopreneWRT | Showa Denko Du-Pont | | | | |
| Conductive addition salt 1 | Lithium-bis (trifluoromethanesulfonyl) imide | Sumitomo Three M | 5 | 5 | | |
| Conductive addition salt 2 | Lithium-trifluoromethanesulfonate | Morita Kagaku Kogyo | | | 0.2 | 5 |
| Conductive addition salt 3 | IL-A1 | Koei Kagaku Kogyo | | | | |
| Conductive addition salt 4 | EMI-TSFI | Stera Chemipha | | | | |
| Conductive addition salt 5 | Potassium-bis(trifluoromethanesulfonyl) imide | Morita Kagaku Kogyo | | | | |
| Carbon HAF | Sheast 3 | Tokai Carbon | 5 | 5 | 5 | 5 |
| Inorganic filler | Calcium carbonate light | Maruo Calcium | 20 | 20 | 20 | 20 |
| Foaming agent 1 | Neocellbon N1000SW | Eiwa Kasei | 4 | 4 | 4 | 4 |
| Foaming agent 2 | Vinyhall AC#3 | Eiwa Kasei | 4 | 4 | 4 | 4 |
| Foaming assistant | Cellpaste 101 | Eiwa Kasei | 4 | 4 | 4 | 4 |
| Vulcanizing agent | Sulfur | Tsurumi Kagaku | 1 | 1 | 1 | 1 |
| Vulcanizing accelerator | DM | Ouchi Shinko Kagaku | 1 | 1 | 1 | 1 |
| Hardness (C) | | | 37 | 35 | 35 | 33 |
| Electric resistance | | | 8.2 | 8.3 | 8.8 | 7.5 |
| Stain of photosensitive member | | | ○ | ○ | ○ | ○ |
| Electrostatic capacity (100 Hz) | | | 36 | 37 | 31 | 33 |
| Equation 1 | | | 3.7 | 4.0 | 2.0 | 2.7 |
| Toner dispersion | | | Not occurred | Not occurred | Not occurred | Not occurred |
| Determination | | | ○ | ○ | ○ | ○ |

| Components | Name | Maker | Example 9 | Example 10 | Example 11 | Example 12 |
|---|---|---|---|---|---|---|
| BR | BR11 | JSR | | | | |
| EPOM | EPT4045 | Mitsui Kagaku | 30 | 100 | 30 | 30 |
| NBR | Nippol 401LL | Zeon | 70 | | 70 | 70 |
| Epichlorohydrin rubber | Zecron 3106 | Zeon | | | | |
| EO-PO-AGE copolymer | ZSN8030 | Zeon | | | | |
| Chloroprene | NeopreneWRT | Showa Denko Du-Pont | | | | |
| Conductive addition salt 1 | Lithium-bis (trifluoromethanesulfonyl) imide | Sumitomo Three M | | | | |
| Conductive addition salt 2 | Lithium-trifluoromethanesulfonate | Morita Kagaku Kogyo | 10 | 5 | | |
| Conductive addition salt 3 | IL-A1 | Koei Kagaku Kogyo | | | | 5 |
| Conductive addition salt 4 | EMI-TSFI | Stera Chemipha | | | | |
| Conductive addition salt 5 | Potassium-bis(trifluoromethanesulfonyl) imide | Morita Kagaku Kogyo | | | 5 | |
| Carbon HAF | Sheast 3 | Tokai Carbon | 5 | 5 | 5 | 5 |
| Inorganic filler | Calcium carbonate light | Maruo Calcium | 20 | 20 | 20 | 20 |
| Foaming agent 1 | Neocellbon N1000SW | Eiwa Kasei | 4 | 4 | 4 | 4 |
| Foaming agent 2 | Vinyhall AC#3 | Eiwa Kasei | 4 | 4 | 4 | 4 |
| Foaming assistant | Cellpaste 101 | Eiwa Kasei | 4 | 4 | 4 | 4 |
| Vulcanizing agent | Sulfur | Tsurumi Kagaku | 1 | 1 | 1 | 1 |
| Vulcanizing accelerator | DM | Ouchi Shinko Kagaku | 1 | 1 | 1 | 1 |
| Hardness (C) | | | 31 | 37 | 33 | 33 |
| Electric resistance | | | 6.9 | 8.5 | 7.6 | 7.7 |
| Stain of photosensitive member | | | ○ | ○ | ○ | ○ |
| Electrostatic capacity (100 Hz) | | | 35 | 28 | 34 | 35 |
| Equation 1 | | | 3.3 | 1.0 | 2.8 | 2.8 |
| Toner dispersion | | | Not occurred | Not occurred | Not occurred | Not occurred |
| Determination | | | ○ | ○ | ○ | ○ |

TABLE 1-continued

| Components | Name | Maker | Example 13 | Example 14 | Example 15 | Example 16 |
|---|---|---|---|---|---|---|
| BR | BR11 | JSR | | 70 | 63 | 80 |
| EPOM | EPT4045 | Mitsui Kagaku | 30 | | | |
| NBR | Nippol 401LL | Zeon | 70 | | | |
| Epichlorohydrin rubber | Zecron 3106 | Zeon | | | | |
| EO-PO-AGE copolymer | ZSN8030 | Zeon | | 30 | 27 | 20 |
| Chloroprene | NeopreneWRT | Showa Denko Du-Pont | | | 10 | |
| Conductive addition salt 1 | Lithium-bis (trifluoromethanesulfonyl) imide | Sumitomo Three M | | | | 2 |
| Conductive addition salt 2 | Lithium-trifluoromethanesulfonate | Morita Kagaku Kogyo | | | | |
| Conductive addition salt 3 | IL-A1 | Koei Kagaku Kogyo | | | | |
| Conductive addition salt 4 | EMI-TSFI | Stera Chemipha | 5 | | | |
| Conductive addition salt 5 | Potassium-bis(trifluoromethanesulfonyl) imide | Morita Kagaku Kogyo | | | | |
| Carbon HAF | Sheast 3 | Tokai Carbon | 5 | 5 | 5 | 5 |
| Inorganic filler | Calcium carbonate light | Maruo Calcium | 20 | 20 | 20 | 20 |
| Foaming agent 1 | Neocellbon N1000SW | Eiwa Kasei | 4 | 4 | 4 | 4 |
| Foaming agent 2 | Vinyhall AC#3 | Eiwa Kasei | 4 | 4 | 4 | 4 |
| Foaming assistant | Cellpaste 101 | Eiwa Kasei | 4 | 4 | 4 | 4 |
| Vulcanizing agent | Sulfur | Tsurumi Kagaku | 1 | 1 | 1 | 1 |
| Vulcanizing accelerator | DM | Ouchi Shinko Kagaku | 1 | 1 | 1 | 1 |
| Hardness (C) | | | 33 | 38 | 39 | 36 |
| Electric resistance | | | 7.7 | 7.5 | 7.4 | 7.7 |
| Stain of photosensitive member | | | ○ | ○ | ○ | ○ |
| Electrostatic capacity (100 Hz) | | | 36 | 33 | 33 | 33 |
| Equation 1 | | | 2.9 | 3.8 | 3.1 | 2.9 |
| Toner dispersion | | | Not occurred | Not occurred | Not occurred | Not occurred |
| Determination | | | ○ | ○ | ○ | ○ |

TABLE 2

| Components | Name | Maker | Comparison Example 1 | Comparison Example 2 | Comparison Example 3 |
|---|---|---|---|---|---|
| BR | BR11 | JSR | | | |
| EPOM | EPT4045 | Mitsui Kagaku | 30 | 100 | |
| NBR | Nippol 401LL | Zeon | 70 | | 70 |
| Epichlorohydrin rubber | Zecron 3106 | Zeon | | | 30 |
| EO-PO-AGE copolymer | ZSN8030 | Zeon | | | |
| Chloroprene | NeopreneWRT | Showa Denko Du-Pont | | | |
| Conductive addition salt 1 | Lithium-bis (trifluoromethanesulfonyl) imide | Sumitomo Three M | 0.1 | 5 | 5 |
| Conductive addition salt 2 | Lithium-trifluoromethanesulfonate | Morita Kagaku Kogyo | | | |
| Conductive addition salt 3 | IL-A1 | Koei Kagaku Kogyo | | | |
| Conductive addition salt 4 | EMI-TSFI | Stera Chemipha | | | |
| Conductive addition salt 5 | Potassium-bis(trifluoromethanesulfonyl) imide | Morita Kagaku Kogyo | | | |
| Carbon HAF | Sheast 3 | Tokai Carbon | 5 | 30 | 5 |
| Inorganic filler | Calcium carbonate light | Maruo Calcium | 20 | 20 | 20 |
| Foaming agent 1 | Neocellbon N1000SW | Eiwa Kasei | 4 | 4 | 4 |
| Foaming agent 2 | Vinyhall AC#3 | Eiwa Kasei | 4 | 4 | 4 |
| Foaming assistant | Cellpaste 101 | Eiwa Kasei | 4 | 4 | 4 |
| Vulcanizing agent | Sulfur | Tsurumi Kagaku | 1 | 1 | 1 |
| Vulcanizing accelerator | DM | Ouchi Shinko Kagaku | 1 | 1 | 1 |
| Hardness (C) | | | 36 | 36 | 33 |
| Electric resistance | | | 9.1 | 8.0 | 7.5 |
| Stain of photosensitive member | | | ○ | ○ | ○ |
| Electrostatic capacity (100 Hz) | | | 30 | 70 | 55 |
| Equation 1 | | | 1.7 | 15.0 | 10.0 |
| Toner dispersion | | | Not occurred | Occurred | Occurred |
| Determination | | | X | X | X |

TABLE 2-continued

| Components | Name | Maker | Comparison Example 4 | Comparison Example 5 | Comparison Example 6 |
|---|---|---|---|---|---|
| BR | BR11 | JSR | | | |
| EPOM | EPT4045 | Mitsui Kagaku | 30 | 100 | |
| NBR | Nippol 401LL | Zeon | 70 | | 70 |
| Epichlorohydrin rubber | Zecron 3106 | Zeon | | | 30 |
| EO-PO-AGE copolymer | ZSN8030 | Zeon | | | |
| Chloroprene | NeopreneWRT | Showa Denko Du-Pont | | | |
| Conductive addition salt 1 | Lithium-bis (trifluoromethanesulfonyl) imide | Sumitomo Three M | | | |
| Conductive addition salt 2 | Lithium-trifluoromethanesulfonate | Morita Kagaku Kogyo | 0.1 | 5 | 5 |
| Conductive addition salt 3 | IL-A1 | Koei Kagaku Kogyo | | | |
| Conductive addition salt 4 | EMI-TSFI | Stera Chemipha | | | |
| Conductive addition salt 5 | Potassium-bis(trifluoromethanesulfonyl) imide | Morita Kagaku Kogyo | | | |
| Carbon HAF | Sheast 3 | Tokai Carbon | 5 | 30 | 5 |
| Inorganic filler | Calcium carbonate light | Maruo Calcium | 20 | 20 | 20 |
| Foaming agent 1 | Neocellbon N1000SW | Eiwa Kasei | 4 | 4 | 4 |
| Foaming agent 2 | Vinyhall AC#3 | Eiwa Kasei | 4 | 4 | 4 |
| Foaming assistant | Cellpaste 101 | Eiwa Kasei | 4 | 4 | 4 |
| Vulcanizing agent | Sulfur | Tsurumi Kagaku | 1 | 1 | 1 |
| Vulcanizing accelerator | DM | Ouchi Shinko Kagaku | 1 | 1 | 1 |
| Hardness (C) | | | 36 | 36 | 33 |
| Electric resistance | | | 9.1 | 8 | 7.5 |
| Stain of photosensitive member | | | ○ | ○ | ○ |
| Electrostatic capacity (100 Hz) | | | 30 | 70 | 55 |
| Equation 1 | | | 1.7 | 15.0 | 10.0 |
| Toner dispersion | | | Not occurred | Occurred | Occurred |
| Determination | | | X | X | X |

In tables 1 and 2, the mixing ratio of each component is shown by part by weight. The electric resistance is expressed in terms of common logarithm ($\log_{10}\Omega$). The reference symbol DM denotes dibenzothiazolyl disulfide. As the foaming agent 1, a chemical foaming agent of 4,4'-oxybis (benzenesulfonylhydrazide (OBSH)) was used. As the foaming agent 2, a chemical foaming agent of azodicarbonamide (ADCA) was used. Urea was used as the foaming assistant.

The conductive addition salt 1 is lithium-bis(trifluoromethanesulfonyl)imide (produced by Sumitomo Three M Inc.). The conductive addition salt 2 is lithium-trifluoromethanesulfonate (produced by Morita Kagaku Kogyo Inc.). The conductive addition salt 3 is hexyltrimethylammonium-bis(trifluoromethanesulfonyl)imide (IL-A1 produced by Koei Kagaku Kogyo Inc.). The conductive addition salt 4 is 1-ethyl-3-methylimidazolyl-bis (trifluoromethanesulfonyl)imide ("EMI-TSFI" produced by Stera Chemipha Inc.). The conductive addition salt 5 is potassium-bis(trifluoromethanesulfonyl)imide (produced by Morita Kagaku Kogyo Inc.).

The equation 1 in tables 1 and 2 show the value of the equation 1: $(C(L)-C(H))/(\log_{10} Hz(H)-\log_{10} Hz(L))$. A value more than zero and less than 10 is a proper value.

EXAMPLES 1 THROUGH 16

As shown in table 1, the value of common logarithm indicating the electric resistance of the conductive roller of each of the examples 1 through 16 fell within the scope of the present invention. The electrostatic capacity of each conductive roller at the frequency of 100 Hz fell within the scope of the present invention, namely, less than 50 pF. The conductive addition salt 1 was used in examples 1 through 6 and 16. The conductive addition salt 2 was used in the examples 7 through 10. The conductive addition salt 5 was used in the example 11. The conductive addition salt 3 was used in the example 12. The conductive addition salt 4 was used in the example 13. In this manner, the kind of the anion-containing salt having the fluoro group and the sulfonyl group was varied in the examples. The conductive elastic layer of each of the examples 14 and 15 did not contain any conductive addition salt.

The cations of the conductive addition salts 5, 3, and 4 contained in the conductive rollers of the examples 11, 12, and 13 respectively were increased to reduce increase of energization.

In the example 16, the mixture of the conductive addition salt 1 and EO-PO-AGE copolymer was used.

COMPARISON EXAMPLES 1 THROUGH 6

The value of common logarithm indicating the electric resistance of the conductive roller of each of the comparison examples 1 through 6 fell out of the scope of the present invention. The electrostatic capacity of each conductive roller at the frequency of 100 Hz also fell out of the scope of the present invention. The conductive addition salt 1 was used in the comparison examples 1 through 3. The conductive addition salt 2 was used in the comparison examples 4 through 6.

The conductive roller of each of the examples and the comparison examples was tested or/and evaluated as described below on the electric resistance, hardness, electrostatic capacity (at 100 Hz), stain or non-stain of the photosensitive member, and toner dispersion.

Electrostatic Capacity

Figure 2:
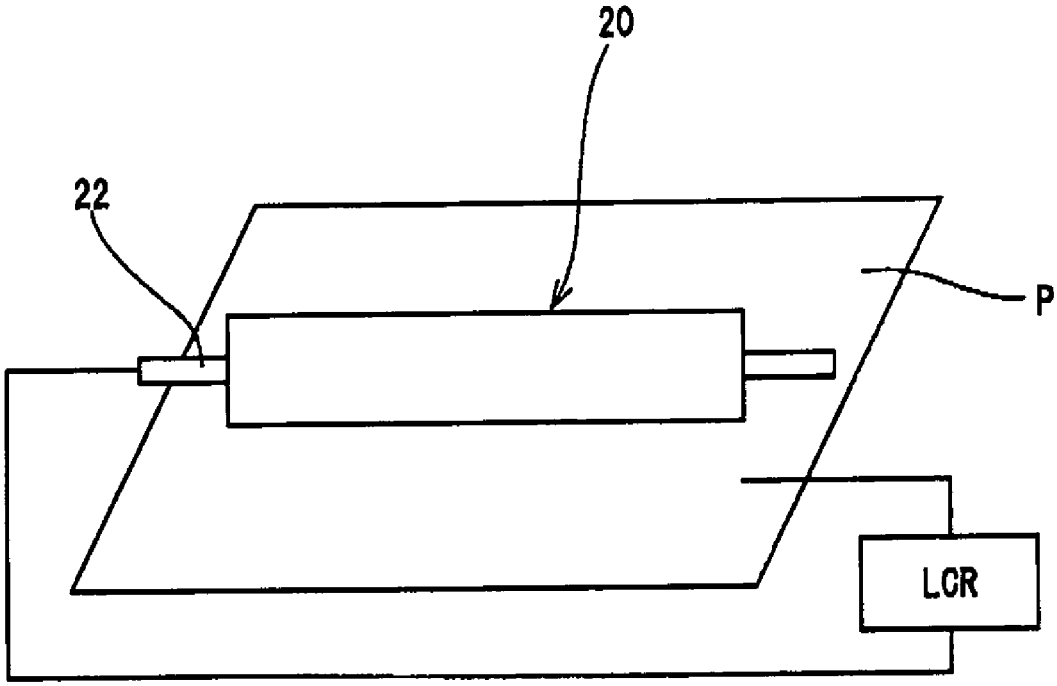
FIG. 2 shows the method of measuring the electrostatic capacity of the conductive roller.

As shown in FIG. 2, with an LCR meter (produced by Toyo Technica), the electrostatic capacity of each conductive roller was measured by using a parallel circuit having an R (electric resistance) component thereof and a C (capacitor) component by applying a voltage between a shaft 22 and an aluminum plate P on which the conductive roller 20 was placed. A load of 500 g was applied to both ends of the shaft 22.

The electrostatic capacity was measured at the frequency of 100 Hz. The low frequency Hz(L) was set to 100 Hz. The high frequency Hz(H) was set to 100000 Hz.

Measurement of Electric Resistance Value

Figure 3:
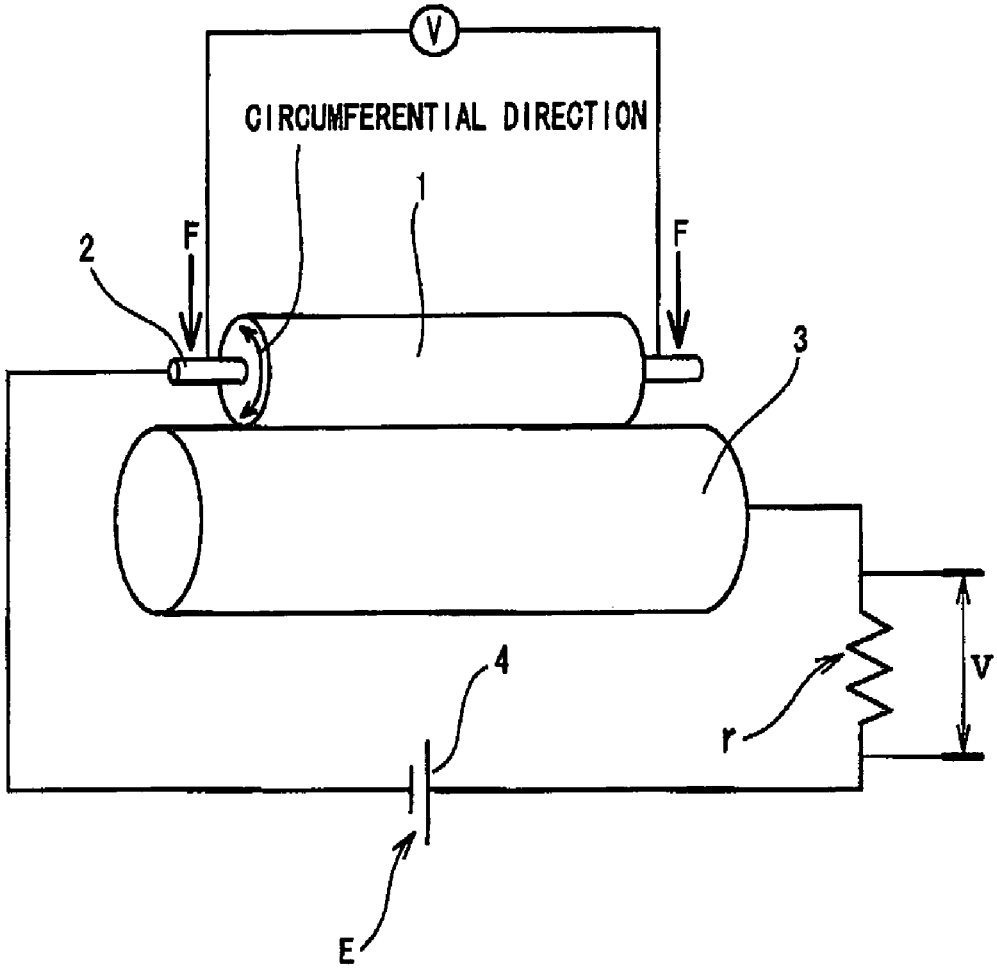
FIG. 3 shows the method of measuring the electric resistance of the conductive roller.

As shown in FIG. 3, at a temperature of 23° C. and a relative humidity of 55%, a conductive elastic layer 1 having a core metal 2 inserted therethrough was mounted on a metal cylinder 3, with the conductive elastic layer 1 in contact with a metal cylinder 3. The leading end of a conductor was connected to the positive side of a power source 4 and to one end surface of the metal cylinder 3. The internal electric resistance of the conductor was r (10 kΩ). The leading end of the conductor was connected to the negative side of the power source 4 and to one end surface of the conductive elastic layer 1. A load F of 500 g was applied to both ends of the core metal 2. The metal cylinder 3 was rotated while a voltage of 1 kV was being applied between the core metal 2 and the metal cylinder 3 to rotate a conductive roller indirectly. The electric resistance was measured 36 times in the circumferential direction. The average of measured resistance values was set as the electric resistance of the conductive roller 20. It is appropriate that the average is not more than $10^9$. Table 1 shows the resistance value of the conductive roller 20 by common logarithm.

Hardness (Shore E)

At a temperature of 23° C. and a relative humidity of 55%, a load of 500 g was applied to right and left ends of the core metal to measure the hardness of the conductive roller with a Shore E hardness meter.

The hardness having a value less than 40 was proper.

Stain of Photosensitive Roller

Each conductive roller was left for two weeks at 40° C. and 90% RH, with each conductive roller pressed against the photosensitive member at a load of 500 g. Whether the surface of the photosensitive member was stained was visually inspected. The conductive roller which did not stain the photosensitive member was marked as ○, whereas the conductive roller which stained the photosensitive member was marked as X.

Evaluation of Toner Dispersion

The evaluation of toner dispersion was made by using a printer LBP HL-1240 produced by Brother Inc.

More specifically, black and white lines having a width of 100 μm were printed out to evaluate toner dispersion. The conductive roller which did not cause occurrence of the toner dispersion was marked as "not occurred", whereas the conductive roller which caused occurrence of the toner dispersion was marked as "occurred".

Determination

The conductive roller which satisfied the demanded performance and was hence superior was marked as ○, whereas the conductive roller which was inferior was marked as X.

As shown in table 2, the electric resistance value of the conductive roller of each of the comparison examples 1 and 4 was more than $10^9$. Thus the conductive rollers were unsuitable for practical use. The conductive roller of each of the comparison examples 2, 3, 5, and 6 had an electrostatic capacity more than 50 pF at the frequency of 100 Hz. Further the value of the equation 1 was much larger than the value specified in the present invention. Thus the conductive rollers caused the toner dispersion.

On the other hand, as shown in Table 1, the conductive roller of each of the examples 1 through 16 had an appropriate hardness (Shore E) in the range from 31 to 39. Thus none of the conductive rollers stained the photosensitive member. The value of the equation 1 was less than 10. None of the conductive rollers caused the toner dispersion. As shown in table 1, it was confirmed that they were all excellent. The conductive roller of each of the examples 5 and 6 contained the BR and the EPDM as its rubber component and the conductive addition salt 1. Thus they had preferable weatherability. A conductive roller containing only BR as its rubber component and the conductive addition salt has ozone-caused deterioration.

The conductive roller of the examples 11, 12, and 13 contained the conductive addition salt 5, the conductive addition salt 3, and the conductive addition salt 4 respectively. Because the cations thereof are a little heavier than the lithium cation of the conductive addition salts 1 and 2, it was possible to greatly reduce the increase of the electric resistance during successive energization. Further the electric resistance value of each conductive roller had a low degree of dependence on environment.

The electric resistance of the conductive roller of the example 14 containing the BR and the EO-PO-AGE copolymer could be adjusted, while its electrostatic capacity was kept small. The conductive roller of the example 15 which contained the BR, the EO-PO-AGE copolymer, and the chloroprene had a lower degree of dependence on environment. The conductive roller of the example 16 that contained the mixture of the EO-PO-AGE copolymer and the conductive addition salt 1 obtained a desired electric resistance, although the conductive roller contained a smaller amount of the EO-PO-AGE copolymer than a conductive roller which contained only the EO-PO-AGE copolymer as the rubber component thereof. Further the conductive roller of the example 16 could reduce the increase of the electric resistance during successive energization to a higher extent than a conductive roller which contained the conductive addition salt 1 but did not contain the EO-PO-AGE copolymer.

Each of the conductive rollers of the examples of the present invention showed a low electric resistance value suitable as the conductive roller for use in an image-forming apparatus. They also showed a low electrostatic capacity. Therefore it could be confirmed that they did not cause the toner dispersion nor stain the photosensitive member. Since they do not contain chlorine, there is no fear that they pollute environment.

What is claimed is:

1. A conductive roller comprising a metallic core metal; and a conductive elastic layer disposed on a peripheral surface of said core metal, said conductive elastic layer containing a rubber component and as an ionic-conductive filler not less than 0.01 parts by weight nor more than 20 parts by weight of an anion-containing salt having a fluoro group and a sulfonyl group added to 100 parts by weight of said rubber component; and said conductive roller having an electrostatic capacity not more than 50 pF at 100 Hz and an electric resistance not less than $10^5\Omega$ nor more than $10^9\Omega$ at an applied of voltage 1000V.

2. The conductive roller according to claim 1, having an electrostatic capacity not less than 10 pF at 100 Hz.

3. The conductive roller according to claim 2, wherein an electrostatic capacity C(L) at an alternating low frequency of $10^2$ Hz(L) and an electrostatic capacity C(H) at an alternating high frequency of $10^5$ Hz(H) satisfy a relationship of:

$$0<(C(L)-C(H))/(\log_{10} \mathrm{Hz}(H)-\log_{10} \mathrm{Hz}(L))<10.$$

4. The conductive roller according to claim 3, wherein the rubber component of said conductive elastic layer is selected from the group consisting of at least one rubber selected from among ethylene-propylene-diene terpolymer, acrylonitrile butadiene rubber, and butadiene rubber.

5. The conductive roller according to claim 2, wherein said ionic-conductive filler is selected from the group consisting of a lithium salt, a potassium salt, a quaternary ammonium salt of and an imidazolyl salts each having a fluoro group and a sulfonyl group capable of dissociating into anions and cations.

6. The conductive roller according to claim 2, wherein the rubber component of said conductive elastic layer is selected from the group consisting of at least one rubber selected from among ethylene-propylene-diene terpolymer, acrylonitrile butadiene rubber, and butadiene rubber.

7. The conductive roller according to claim 2, wherein the ionic-conductive filler is present in an amount of not less than 5 parts by weight nor more than 15 parts by weight with respect to 100 parts by weight of said rubber component.

8. The conductive roller according to claim 2, wherein the ionic-conductive filler is a bisfluoroalkylsulfonylimide or a trisfluoroalkylsulfonylimide salt.

9. The conductive roller according to claim 1, wherein an electrostatic capacity C(L) at an alternating low frequency of $10^2$ Hz(L) and an electrostatic capacity C(H) at an alternating high frequency of $10^5$ Hz(H) satisfy a relationship of:

$$0<(C(L)-C(H))/(\log_{10} \mathrm{Hz}(H)-\log_{10} \mathrm{Hz}(L))<10.$$

10. The conductive roller according to claim 9, wherein said ionic-conductive filler is selected from the group consisting of a lithium salt, a potassium salt, a quaternary ammonium salt and an imidazolyl salt, each having a fluoro group and a sulfonyl group capable of dissociating into anions and cations.

11. The conductive roller according to claim 9, wherein the rubber component of said conductive elastic layer is selected from the group consisting of at least one rubber selected from among ethylene-propylene-diene terpolymer, acrylonitrile butadiene rubber, and butadiene rubber.

12. The conductive roller according to claim 1, wherein said ionic-conductive filler is selected from the group consisting of a lithium salt, a potassium salt, a quaternary ammonium salt and an imidazolyl salt, each having a fluoro group and a sulfonyl group capable of dissociating into anions and cations.

13. The conductive roller according to claim 12, wherein the ionic-conductive filler is present in an amount of not less than 5 parts by weight nor more than 15 parts by weight with respect to 100 parts by weight of said rubber component.

14. The conductive roller according to claim 12, wherein the ionic-conductive filler is a bisfluoroalkylsulfonylimide or a trisfluoroalkylsulfonylimide salt.

15. The conductive roller according to claim 1, wherein the rubber component of said conductive elastic layer is selected from the group consisting of at least one rubber selected from among ethylene-propylene-diene terpolymer, acrylonitrile butadiene rubber, and butadiene rubber.

16. The conductive roller according to claim 15, wherein the ionic-conductive filler is present in an amount of not less than 5 parts by weight nor more than 15 parts by weight with respect to 100 parts by weight of said rubber component.

17. The conductive roller according to claim 15, wherein the ionic-conductive filler is a bisfluoroalkylsulfonylimide or a trisfluoroalkylsulfonylimide salt.

18. The conductive roller according to claim 1, wherein the ionic-conductive filler is present in an amount of not less than 5 parts by weight nor more than 15 parts by weight with respect to 100 parts by weight of said rubber component.

19. The conductive roller according to claim 1, wherein the ionic-conductive filler is a bisfluoroalkylsulfonylimide or a trisfluoroalkylsulfonylimide salt.

* * * * *